US010053973B2

(12) United States Patent
Drenth et al.

(10) Patent No.: US 10,053,973 B2
(45) Date of Patent: Aug. 21, 2018

(54) BRAKING DEVICES FOR DRILLING OPERATIONS, AND SYSTEMS AND METHODS OF USING SAME

(71) Applicant: LONGYEAR TM, INC., South Jordan, UT (US)

(72) Inventors: Christopher L. Drenth, Burlington (CA); George Iondov, Mississauga (CA); Martin Romeo Savoie, Hanmer (CA)

(73) Assignee: LONGYEAR TM, INC., Salt Lake City, UT (US)

( * ) Notice: Subject to any disclaimer, the term of this patent is extended or adjusted under 35 U.S.C. 154(b) by 322 days.

(21) Appl. No.: 14/870,247

(22) Filed: Sep. 30, 2015

(65) Prior Publication Data

US 2017/0089191 A1 Mar. 30, 2017

(51) Int. Cl.

| | |
|---|---|
| ***E21B 47/00*** | (2012.01) |
| ***E21B 25/02*** | (2006.01) |
| ***E21B 23/01*** | (2006.01) |

(52) U.S. Cl.

CPC ..... *E21B 47/00* (2013.01); *E21B 23/01* (2013.01); *E21B 25/02* (2013.01)

(58) Field of Classification Search

CPC ..... E21B 23/08; E21B 23/10; E21B 31/20

See application file for complete search history.

(56) References Cited

U.S. PATENT DOCUMENTS

| | | | |
|---|---|---|---|
| 2,182,797 | A | 12/1939 | Dillon |
| 2,521,886 | A | 9/1950 | Walker, Jr. |
| 3,225,845 | A | 12/1965 | Koontz et al. |
| 3,930,679 | A | 1/1976 | Anderson et al. |

(Continued)

FOREIGN PATENT DOCUMENTS

| | | | |
|---|---|---|---|
| WO | WO-2015/103027 | A1 | 7/2015 |
| WO | WO-2017/058712 | A1 | 4/2017 |
| WO | WO-2017/106311 | A1 | 6/2017 |

OTHER PUBLICATIONS

International Search Report and Written Opinion dated Dec. 8, 2016 by the International Searching Authority for Application No. PCT/US2016/053703 which was filed on Sep. 26, 2016 (Applicant—Longyear TM, Inc.) (8 pages).

(Continued)

*Primary Examiner* — David J Bagnell
*Assistant Examiner* — Brandon M Duck
(74) *Attorney, Agent, or Firm* — Ballard Spahr LLP

(57) ABSTRACT

A brake device for engaging an inner surface of a drill string within a borehole. The brake device has a driving member that defines a plurality of wedge surfaces, a brake retainer that receives at least a portion of the driving member, and a plurality of braking elements positioned in contact with at least a portion of the outer surface of the driving member. The brake retainer has a biasing member that is operatively coupled to the driving member. The biasing member of the brake retainer biases the driving member in a proximal direction relative to the longitudinal axis of the drill string to position the wedge surfaces in contact with corresponding braking elements, and the wedge surfaces drive the braking elements radially outwardly to engage the inner surface of the drill string. The brake device is not coupled to an inner tube assembly.

26 Claims, 8 Drawing Sheets

(56) References Cited

U.S. PATENT DOCUMENTS

| | | | | |
|---|---|---|---|---|
| 5,967,477 | A | 10/1999 | Walmsley | |
| 7,198,311 | B1 | 4/2007 | Potts et al. | |
| 7,552,764 | B2 | 6/2009 | Weems et al. | |
| 7,744,140 | B2 | 6/2010 | Rowley | |
| 7,854,266 | B2 | 12/2010 | Watson | |
| 8,186,246 | B2 | 5/2012 | Niven | |
| 8,720,541 | B2 | 5/2014 | Ellis et al. | |
| 9,163,651 | B2 | 10/2015 | Ostrobrod | |
| 9,546,524 | B2 | 1/2017 | Drenth et al. | |
| 2003/0000742 | A1 | 1/2003 | Juhasz et al. | |
| 2004/0134667 | A1 | 7/2004 | Brewer et al. | |
| 2007/0261857 | A1 | 11/2007 | Kuttel et al. | |
| 2008/0236841 | A1 | 10/2008 | Howlett et al. | |
| 2009/0095489 | A1 | 4/2009 | Roodenburg et al. | |
| 2009/0260882 | A1* | 10/2009 | Drenth | E21B 23/01 175/57 |
| 2009/0321064 | A1 | 12/2009 | Ellis et al. | |
| 2011/0100719 | A1 | 5/2011 | Mildren et al. | |
| 2011/0174500 | A1 | 7/2011 | Davies et al. | |
| 2013/0292136 | A1 | 11/2013 | McIntosh et al. | |
| 2014/0090856 | A1 | 4/2014 | Pratt et al. | |
| 2014/0174832 | A1 | 6/2014 | Drenth et al. | |
| 2015/0122490 | A1 | 5/2015 | Greening et al. | |
| 2015/0184471 | A1 | 7/2015 | Drenth et al. | |
| 2015/0247367 | A1 | 9/2015 | Angelle et al. | |
| 2016/0061023 | A1* | 3/2016 | Paszek | E21B 23/08 166/381 |
| 2017/0089152 | A1 | 3/2017 | Drenth et al. | |

OTHER PUBLICATIONS

International Search Report and Written Opinion dated Apr. 1, 2015 by the International Searching Authority for Application No. PCT/US2014/072084 which was filed on Dec. 23, 2014 and published as WO/2015/103027 on Jul. 9, 2015 (Applicant—Longyear TM, Inc.; Inventor—Christopher, L. Drenth et al.) (16 pages).

International Preliminary Report on Patentability dated Jul. 5, 2016 by the International Searching Authority for Application No. PCT/US2014/072084 which was filed on Dec. 23, 2014 and published as WO/2015/103027 on Jul. 9, 2015 (Applicant—Longyear TM, Inc.; Inventor—Christopher, L. Drenth et al.) (16 pages).

Non Final Rejection dated Aug. 3, 2016 by the U.S. Patent and Trademark Office for U.S. Appl. No. 14/192,569, filed Feb. 27, 2014 and granted as U.S. Pat. No. 9,546,524 on Jan. 17, 2017 (Applicant—Longyear TM, Inc.; Inventor—Christopher L. Drenth et al.) (8 pages).

Response to Non Final Rejection dated Oct. 3, 2016 to the U.S. Patent and Trademark Office for U.S. Appl. No. 14/192,569, filed Feb. 27, 2014 and granted as U.S. Pat. No. 9,546,524 on Jan. 17, 2017 (Applicant—Longyear TM, Inc.; Inventor—Christopher L. Drenth et al.) (9 pages).

Notice of Allowance dated Oct. 17, 2016 by the U.S. Patent and Trademark Office for U.S. Appl. No. 14/192,569, filed Feb. 27, 2014 and granted as U.S. Pat. No. 9,546,524 on Jan. 17, 2017 (Applicant—Longyear TM, Inc.; Invento—Christopher L. Drenth et al.) (5 pages).

Issue Notification dated Dec. 28, 2016 by the U.S. Patent and Trademark Office for U.S. Appl. No. 14/192,569, filed Feb. 27, 2014 and granted as U.S. Pat. No. 9,546,524 on Jan. 17, 2017 (Applicant—Longyear TM, Inc.; Inventor—Christopher L. Drenth et al.) (1 page).

International Search Report and Written Opinion dated Apr. 20, 2017 by the International Searching Authority for International Application No. PCT/US2016/066608, which was filed on Dec. 14, 2016 and published as WO/2017/106311 on Jun. 22, 2017 (Applicant—BLY IP Inc.) (8 pages).

Examination Report dated Oct. 30, 2017 by the Australian Patent Office for AU Application No. 2014374101, which was filed on Dec. 23, 2014(Applicant—Longyear TM, Inc.) (3 pages).

Supplementary European Search Report and Written Opinion dated Jun. 26, 2017 by the European Patent Office for EP Application No. 14876890.6, which was filed on Dec. 23, 2014 and published as EP 3090120 on Nov. 9, 2016 (Applicant—Longyear TM, Inc.) (7 pages).

Non Final Rejection dated Nov. 24, 2017 by the U.S. Patent and Trademark Office for U.S. Appl. No. 15/379,016, filed Dec. 14, 2016 and published as US 2017/0089152 A1 on Mar. 30, 2017 (Inventor—Christopher L. Drenth et al.) (6 pages).

* cited by examiner

BRAKING DEVICES FOR DRILLING OPERATIONS, AND SYSTEMS AND METHODS OF USING SAME

FIELD

The disclosed invention relates to braking devices that are used during drilling operations, including, for example and without limitations, pump-in braking devices that are deployed within horizontal or upwardly oriented boreholes.

BACKGROUND

Exploration drilling often includes retrieving a sample of a desired material from a formation. In a conventional process used in exploration drilling, an open-faced drill bit is attached to the bottom or leading edge of a core barrel for retrieving the desired sample. The core barrel includes an outer portion attached to the drill string and an inner portion that collects the sample. The drill string is a series of connected drill rods that are assembled section by section as the core barrel moves deeper into the formation. The core barrel is rotated and/or pushed into the desired formation to obtain a sample of the desired material (often called a core sample). Once the core sample is obtained, the inner portion containing the core sample is retrieved by removing (or tripping out) the entire drill string out of the hole that has been drilled (the borehole). Each section of the drill rod must be sequentially removed from the borehole. The core sample can then be removed from the core barrel.

In a wireline exploration drilling process, the core barrel assembly (or other drilling tool) is positioned on a drill string and advanced into the formation. The core barrel assembly includes an outer portion and an inner tube assembly positioned within the outer portion. The outer portion of the core barrel again is often tripped with a drill bit and is advanced into the formation. However, the inner tube assembly of the core barrel often does not contain a drill bit and is not connected to a drill string. Instead, the inner tube assembly is releasably locked to the outer portion and the entire core barrel assembly is advanced together. When the core sample is obtained, the inner tube assembly is unlocked from the outer portion and is retrieved using a retrieval system. The core sample is then removed and the inner tube assembly placed back into the outer portion using the retrieval system. Thus, the wireline system reduces the time needed to trip drill rods of a drill string in and out when obtaining a core sample because the wireline system is used instead.

In some drilling applications, a horizontal or upwardly oriented borehole is used. In such applications, an inner tube assembly is pumped into place using a valve and seal portion on the core barrel assembly by applying hydraulic pressure behind the seal portion, thereby forcing the inner tube assembly into the horizontal or upwardly oriented borehole. Once the inner tube assembly is in position and locked to the outer portion, the hydraulic pressure is removed and the core barrel assembly advanced. To retrieve the inner tube assembly, a wireline may be pumped into the borehole in a similar manner, and the inner tube assembly can be uncoupled and removed as described above.

While such a process can reduce the time associated with retrieving core samples, difficulties can arise in removing the inner tube assembly. For example, occasionally the inner tube assembly can fall out of the drill string, causing potential hazards to equipment and personnel at the surface as the core barrel assembly exits the borehole at potentially a high velocity.

During drilling operations, it is sometimes necessary to obtain information regarding the conditions or characteristics of the borehole. Conventionally, in order to obtain such information, the entire drill string must be withdrawn from the borehole, and surveying/measurement equipment can then be lowered into the borehole to obtain appropriate measurements. The removal of the drill string presents a lengthy stoppage of drilling operations and greatly reduces the efficiency of the drilling process.

Thus, there is a need for braking devices that can prevent or minimize the hazards associated with undesired proximal movement of drilling components within a borehole. There is a further need for mechanisms for obtaining information regarding the conditions or characteristics of a borehole without the need for completely removing a drill string from the borehole.

SUMMARY

Described herein, in various aspects, is a brake device for engaging an inner surface of a drill string within a borehole (or an inner surface of the wall defining the borehole itself). The brake device can be configured for axial movement relative to a longitudinal axis of the drill string. In some aspect, the brake device is not coupled to an inner tube assembly. The brake device can have a driving member, a brake retainer, and a plurality of braking elements. The driving member can have an outer surface that defines a plurality of wedge surfaces. The brake retainer can have an inner surface that defines a central bore that receives at least a portion of the driving member. The brake retainer can define a plurality of radial openings positioned in communication with the central bore. The brake retainer can have a biasing member that is operatively coupled to the driving member. The plurality of braking elements can be positioned in contact with at least a portion of the outer surface of the driving member. The biasing member of the brake retainer can be configured to bias the driving member in a proximal direction relative to the longitudinal axis of the drill string to position the plurality of wedge surfaces of the driving member in contact with corresponding braking elements of the plurality of braking elements. The plurality of wedge surfaces of the driving member can be configured to drive the plurality of braking elements radially outwardly into corresponding radial openings of the brake retainer to engage the inner surface of the drill string (or the inner surface of the borehole).

The wedge surfaces of the driving member can be configured to wedge the plurality of braking elements against the inner surface of the drill string when the brake device is moved in a proximal direction relative to the drill string, and upon wedging of the plurality of braking elements against the inner surface of the drill string (or the inner surface of the borehole), the brake device can be axially locked relative to the longitudinal axis of the drill string. In contrast, the wedge surfaces of the driving member do not wedge the plurality of braking elements against the inner surface of the drill string when the brake device is moved in a distal direction relative to the drill string.

Systems and methods of using the disclosed brake device are also described.

DETAILED DESCRIPTION

Figure 1:
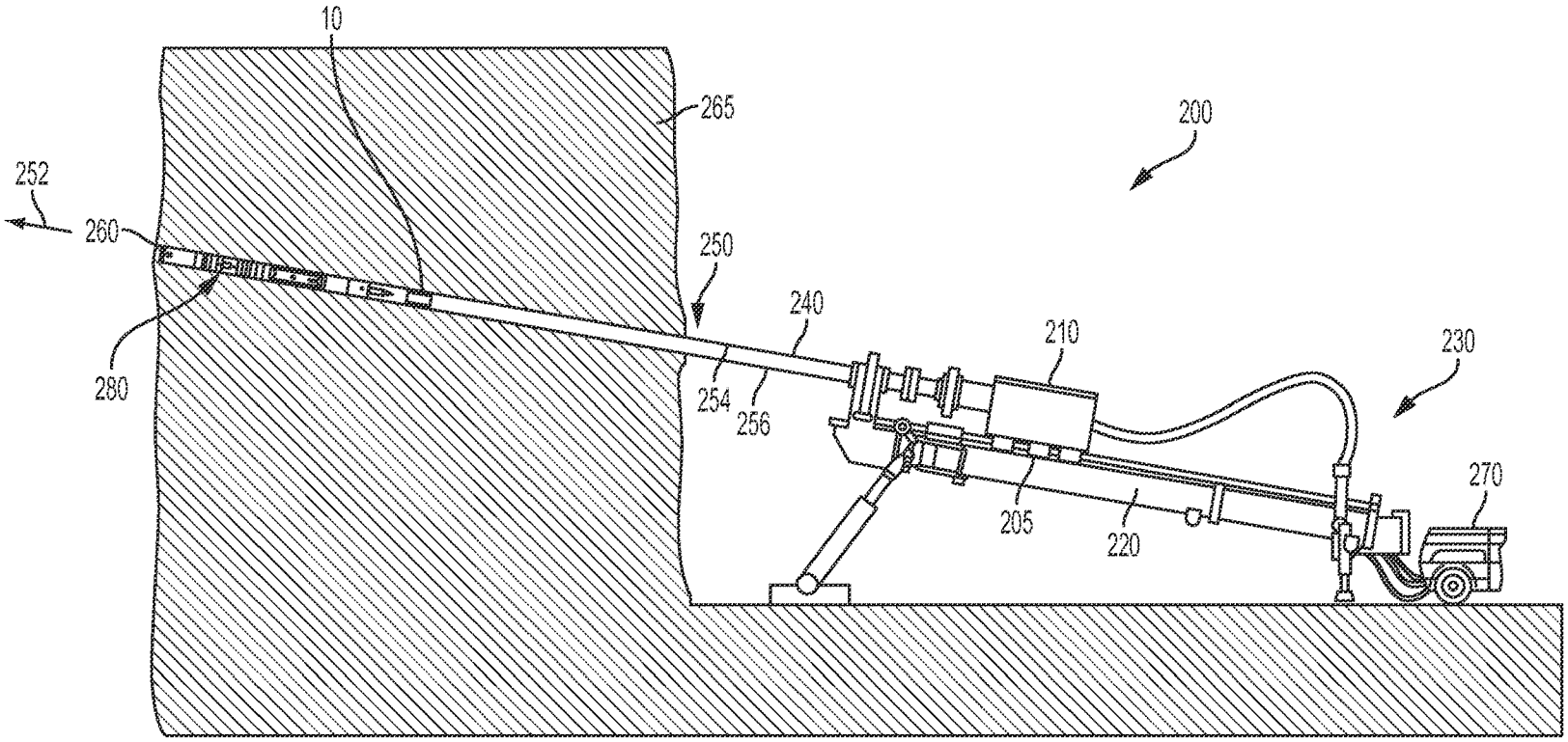
FIG. 1 is a side perspective view of an exemplary drilling system having a brake device as disclosed herein.

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout. It is to be understood that this invention is not limited to the particular methodology and protocols described, as such may vary. It is also to be understood that the terminology used herein is for the purpose of describing particular embodiments only, and is not intended to limit the scope of the present invention.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

As used herein the singular forms "a", "an", and "the" include plural referents unless the context clearly dictates otherwise. For example, use of the term "a threaded connector" can refer to one or more of such threaded connectors.

All technical and scientific terms used herein have the same meaning as commonly understood to one of ordinary skill in the art to which this invention belongs unless clearly indicated otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The word "or" as used herein means any one member of a particular list and also includes any combination of members of that list.

The following description supplies specific details in order to provide a thorough understanding. Nevertheless, the skilled artisan would understand that the apparatus and associated methods of using the apparatus can be implemented and used without employing these specific details. Indeed, the apparatus and associated methods can be placed into practice by modifying the illustrated apparatus and associated methods and can be used in conjunction with any other apparatus and techniques conventionally used in the industry. For example, while the description below focuses on using a braking device in exploratory drilling operations, the apparatus and associated methods could be used in many different processes where devices and tools are inserted into a hole or tubular member, such as well testing, oil and gas drilling operations, pipe cleaning, etc.

FIG. 1 illustrates a drilling system 200 that includes a sled assembly 205 and a drill head 210. The sled assembly 205 can be coupled to a slide frame 220 as part of a drill rig 230. The drill head 210 is configured to have one or more threaded member(s) 240 coupled thereto. Threaded members can include, without limitation, drill rods and casings. For ease of reference, the tubular threaded member 240 will be described as drill rod. The drill rod 240 can in turn be coupled to additional drill rods to form a drill string 250. In turn, the drill string 250 can be coupled to a core barrel assembly having a drill bit 260 or other in-hole tool configured to interface with the material to be drilled, such as a formation 265.

In the illustrated example, the slide frame 220 can be oriented such that the drill string 250 is generally horizontal or oriented upwardly relative to the horizontal. Further, the drill head 210 is configured to rotate the drill string 250 during a drilling process. In particular, the drill head 210 may vary the speed at which the drill head 210 rotates as well as the direction. The rotational rate of the drill head and/or the torque the drill head 210 transmits to the drill string 250 may be selected as desired according to the drilling process.

The sled assembly 205 can be configured to translate relative to the slide frame 220 to apply an axial force to the drill head 210 to urge the drill bit 260 into the formation 265 as the drill head 210 rotates. In the illustrated example, the drilling system 200 includes a drive assembly 270 that is configured to move the sled assembly 205 relative to the slide frame 220 to apply the axial force to the drill bit 260 as described above. As will be discussed in more detail below, the drill head 210 can be configured in a number of ways to suit various drilling conditions.

The drilling system 200 further includes an inner tube assembly 280 and a braking device 10 as further disclosed herein. The braking device 10 is configured to help prevent unintended expulsion of drilling tools and devices from a borehole in the formation 265. A locking or positioning assembly of a retrieval mechanism (such as a wireline spear point, cable connection, a vacuum pump-in seal, etc.) may be coupled to the proximal end of the braking device 10 so that the braking device is between the drilling assembly and the retrieval mechanism. Optionally, in other examples, the braking device 10 can be integrally formed with the retrieval mechanism. In the example described below, the braking device 10 comprises brake elements that are configured to selectively engage an inner surface of an outer casing (drill string) or an inner surface of a borehole wall.

As further disclosed herein, a biasing member (such as a spring) can maintain brake elements in contact with tapered wedge surfaces of a driving member and the inner wall so that some friction can exist at all times if desired. In this arrangement, the friction of the braking elements increases as the tapered wedge surface is pushed into increasing engagement with the braking elements. Thus, as a force is applied on the drilling assembly in a proximal direction (in the direction out of the borehole), the tapered wedge surface is pressed into the braking elements. The result of this action increases the friction between the braking elements and the inner wall, causing the drilling assembly to brake and, with sufficient force, stop in the borehole.

Such a braking device may be useful in both down-hole and up-hole drilling operations. In up-hole drilling operations, where the borehole is drilled at an upward angle, the assembly may be pumped into the borehole using any suitable techniques and/or components. Thus, the braking device 10 resists unintended removal or expulsion of the drilling assembly from the borehole by engaging braking elements in a frictional arrangement between the wedge surfaces of a driving member and an inner wall of the casing or drill string (or borehole).

Disclosed herein, in various aspects and with reference to FIGS. 1-7 is a brake device 10 for engaging an inner surface 254 of a drill string 250 within a borehole 210 (or an inner surface of the borehole). In use, the brake device 10 can be configured for axial movement relative to a longitudinal axis 252 of the drill string 250. In exemplary aspects, the brake device 10 can comprise a driving member 20, a brake retainer 30, and a plurality of braking elements 60. Optionally, in exemplary aspects, the brake device 10 is not coupled to an inner tube assembly. In these aspects, it is contemplated that the brake device 10 can be a pump-in brake device that is pumped into the borehole using pressurized fluid in the manner known in the art.

Figure 3:
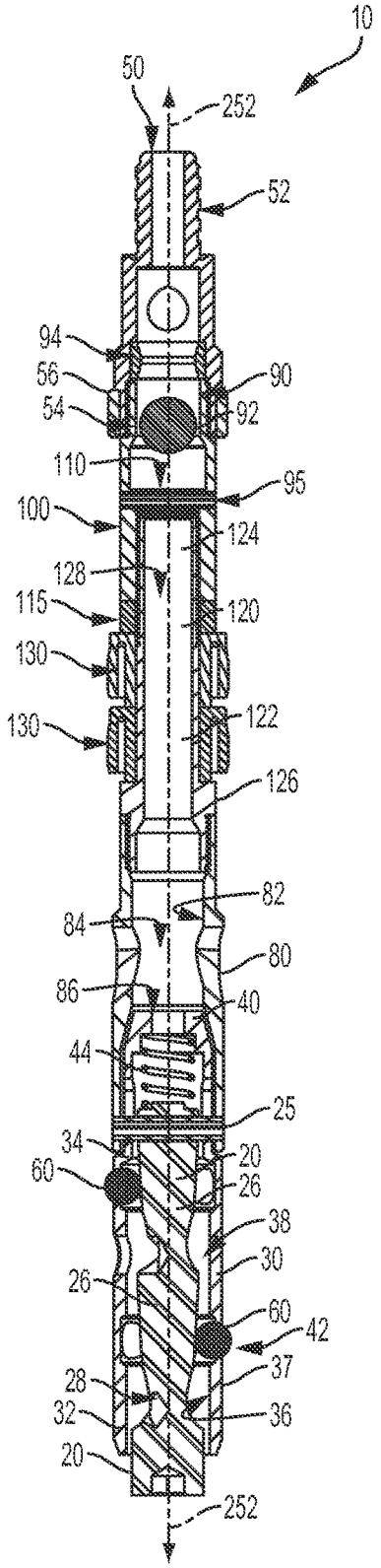
FIG. 3 is a front cross-sectional view of an exemplary brake device as disclosed herein.
Figure 4A:
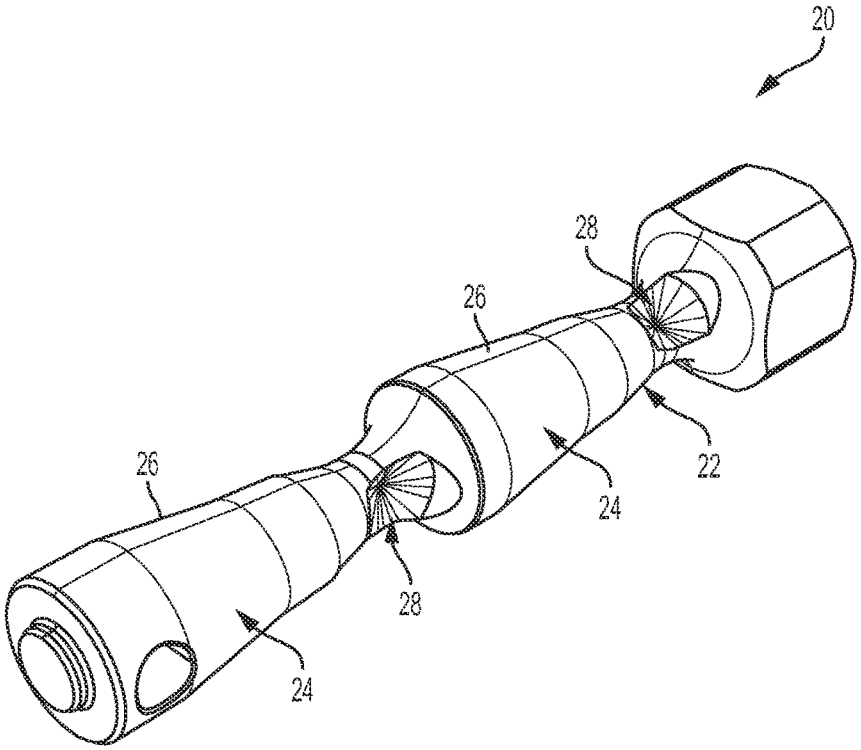
FIG. 4A is a perspective view of an exemplary drive member of a brake device as disclosed herein.
Figure 4B:
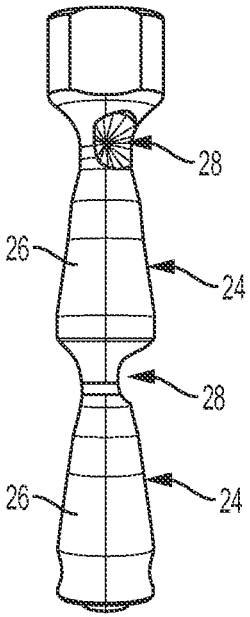
FIGS. 4B and 4C are side views of the drive member of FIG. 4A.
Figure 4C:
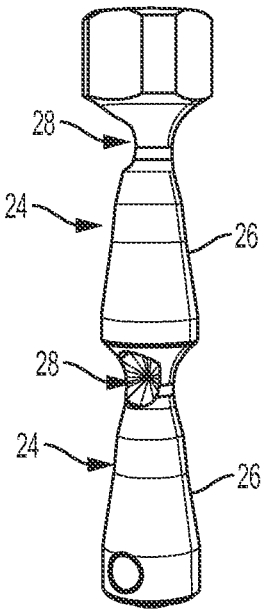

In one aspect, and with reference to FIGS. 3-4C, the driving member 20 can have an outer surface 22 that defines at least one wedge surface 24. Optionally, in this aspect, the at least one wedge surface 24 can comprise a plurality of wedge surfaces 24. In exemplary aspects, the outer surface of the driving member can have at least one tapered portion that is axially tapered moving in a proximal direction (moving toward the exit of the bore hole) relative to the longitudinal axis 252 of the drill string 250. Optionally, in these aspects, the at least one tapered portion can have a complex axial taper. In further exemplary aspects, each tapered portion of the outer surface 22 can define a respective wedge surface 24. Optionally, in further exemplary aspects, at least a portion of each wedge surface can be axially tapered relative to the longitudinal axis of the drill string. It is contemplated that the larger diameter portions (e.g., wedge surfaces 24) of the outer surface 22 of the driving member 20 can be sized to drive braking elements into the material of the inner surface of a drill rod that is provided as part of the drill string 250. Optionally, the larger diameter portions (e.g., wedge surfaces 24) of the outer surface 22 of the driving member 20 can be sized to drive braking elements 60 to a radial position beyond an inner diameter defined by the drill string 250. It is further contemplated that the smaller diameter portions (e.g., the smaller diameter portions of the tapered portion) of the outer surface 22 of the driving member 20 can be configured to allow brake elements 60 to remain in a minimal rolling contact position during distal motion of the brake device 10. In still further exemplary aspects, the outer surface 22 of the driving member 20 can define at least one recessed portion 28 that is radially recessed toward the longitudinal axis 252 of the drill string 250 (relative to adjacent portions of the driving member). Optionally, in these aspects, the at least one recessed portion 28 can comprise a plurality of recessed portions. It is contemplated that the recessed portions 28 (e.g., pockets) of the driving member can be provided to allow for assembly and/or secure positioning of braking elements into or within the housing of the brake device.

Optionally, in additional exemplary aspects, the driving member 20 can comprise a single (e.g., integrally or monolithically formed) component 26 that defines the wedge surfaces. Alternatively, in further optional aspects, the driving member 20 can comprise a plurality of axially spaced driving components 26. In these aspects, each driving component 26 of the plurality of driving components can define at least one wedge surface 24 of a plurality of wedge surfaces. In exemplary aspects, the plurality of axially spaced driving components 26 can be configured for threaded connection to one another. For example, the plurality of axially spaced driving components 26 can comprise a first driving component that defines at least one wedge surface (optionally provided as part of a tapered outer surface) and a second driving component that defines at least one wedge surface (optionally provided as part of a tapered outer surface), with the first driving component further defining a receptacle having a threaded inner surface and the second driving component further defining a threaded end configured for receipt within and engagement with the first driving component.

Figure 2:
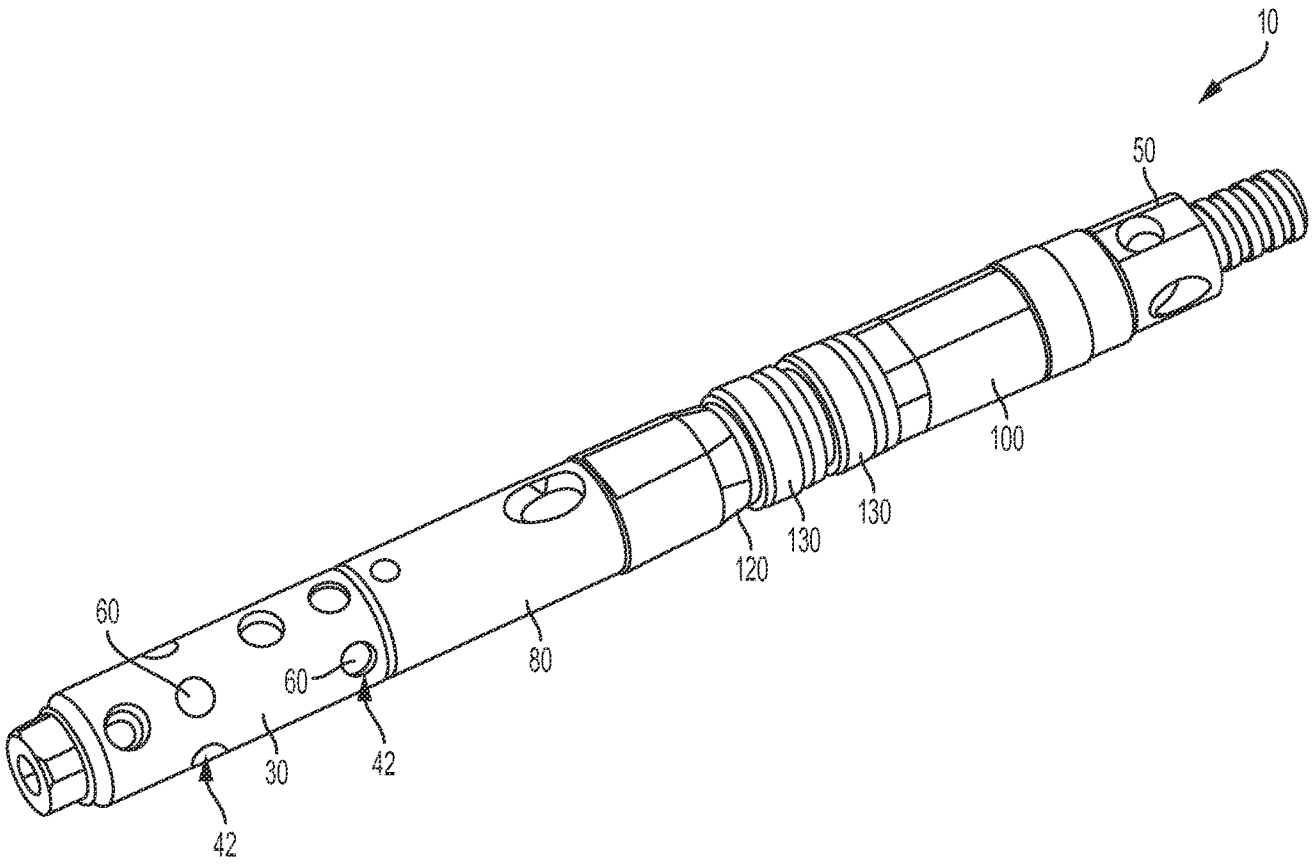
FIG. 2 is a perspective view of an exemplary brake device as disclosed herein.
Figure 5:
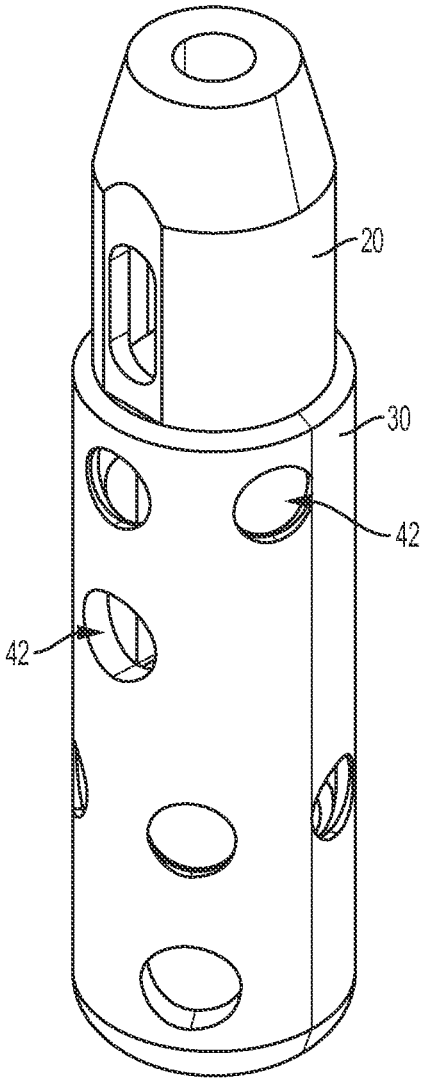
FIG. 5 is a perspective view of an exemplary drive member and brake retainer of a brake device as disclosed herein.

In another aspect, as shown in FIGS. 2-3 and 5, the brake retainer 30 can have an inner surface 36 that defines a central bore 38 that receives at least a portion of the driving member 20. In this aspect, the brake retainer 30 can define a plurality of radial openings 42 extending between the inner surface 38 and an outer surface 37 of the brake retainer and positioned in communication with the central bore 38. In an additional aspect, the brake retainer 30 can comprise a biasing member 44 that is operatively coupled to the driving member 20. Optionally, the biasing member 44 can be a spring.

In a further aspect, and with reference to FIG. 3, the plurality of braking elements 60 can be positioned in contact with at least a portion of the outer surface 22 of the driving member 20. It is contemplated that the plurality of braking elements 60 can comprise any conventional structure that is capable of applying a radial force to the inner surface of a drill string (or the inner surface of a borehole) to axially lock the brake device 10 relative to the longitudinal axis 252 of the drill string 250. For example, in one aspect, the plurality of braking elements 60 can comprise a plurality of rollers. In another exemplary aspect, the plurality of braking elements 60 can comprise a plurality of balls. Optionally, the plurality of braking elements 60 (e.g., the plurality of balls) can be unattached to other portions of the brake device 10. The braking elements 60 can be made of any material suitable for being used as a rolling and/or wedging braking element. For example, the braking elements 234 can be made of steel or other iron alloys, tool steel, tungsten carbide, titanium and titanium alloys, compounds using aramid fibers, lubrication impregnated nylons or plastics, or combinations thereof. The material used for any braking element can be the same or different than any other brake element.

In exemplary aspects, and as shown in FIG. 3, the plurality of braking elements 60 can comprise a plurality of opposed sets of braking elements. Optionally, in these aspects, each set of braking elements can comprise a plurality of braking elements that are substantially equally circumferentially spaced about the longitudinal axis of the drill string.

In operation, the biasing member 44 of the brake retainer 30 can be configured to bias the driving member 20 in a proximal direction relative to the longitudinal axis 252 of the drill string 250 to position the wedge surfaces 24 of the driving member in contact with corresponding braking elements 60. In exemplary aspects, the wedge surfaces 24 of the driving member 20 can be configured to drive the plurality of braking elements 60 radially outwardly into corresponding radial openings 42 of the brake retainer 30 to engage the inner surface 254 of the drill string 250. In further exemplary aspects, the wedge surfaces 24 of the driving member 20 can be configured to wedge the plurality of braking elements 60 against the inner surface 254 of the drill string 250 when the brake device 10 is moved in a proximal direction relative to the drill string (toward the exit/entrance of the hole). In these aspects, upon wedging of the plurality of braking elements 60 against the inner surface 254 of the drill string 250, the brake device 10 can be axially locked relative to the longitudinal axis 252 of the drill string. In exemplary aspects, it is contemplated that the wedge surfaces 24 of the driving member 20 can cooperate with the braking elements 60 to provide a self-energizing gripping force that can increase at least one of a radial biasing force and a contact friction force applied to the inner surface of the drill string and/or an inner surface of a borehole. In these aspects, it is understood that the self-energizing gripping force can be applied without the application of additional forces by fluid pressure and/or a hoisting device.

In still further exemplary aspects, the wedge surfaces 24 of the driving member 20 do not wedge the plurality of braking elements 60 against the inner surface 254 of the drill string 250 when the brake device is moved in a distal direction relative to the drill string. It is contemplated that the braking elements 60 can maintain some level of engagement with the inner surface 254 of the drill string 250 even when the brake device 10 is moved in a distal direction relative to the drill string, but the braking elements do not axially lock the brake device in place when the brake device is moved in the distal direction. In use, it is contemplated that wedging and active braking by the braking elements 60 does not occur unless undesired motion occurs in a proximal direction (e.g., due to gravitational forces or a flow of pressurized fluid or gas). In additional aspects, when the driving member 20 is moved in a distal direction (e.g., such as upon landing in an up-hole drilling operation or during tripping in a down-hole drilling operation), it is contemplated that the recessed portions 28 of the driving member 20 can be configured to receive corresponding braking elements 60 as the braking elements are translated along the outer surface of the driving member 20 from wedge surfaces 24 to lesser diameter portions of the member and, then, ultimately, to a recessed portion. In use, it is further contemplated that lesser diameter portions of the driving member 20 (e.g., lesser diameter portions of the tapered portions of the driving member) can be configured to allow the braking elements 60 to remain in a minimal rolling contact position during distal movement of the braking device 10. In exemplary aspects, it is contemplated that the recessed portions 28 (e.g. pockets) of the driving member 20 can be configured to receive and/or retain respective braking elements 60 to allow for assembly and/or secure positioning of the braking elements into or within the housing of the brake device (which is partially defined by the driving member).

In an aspect, the brake retainer 30 can define a proximal end 32 and an opposed distal end, with the proximal end defining a proximal end of the brake device. Optionally, in another aspect, the brake device 10 can have a threaded connector 50 that defines a distal end of the brake device that is axially opposed to the proximal end of the brake device. Optionally, in exemplary aspects and with reference to FIGS. 6-7, the threaded connector 50 can be configured for complementary engagement with at least one selected instrument 70. In these aspects, the threaded connector 50 can optionally be an E-thread connector as is known in the art. Thus, in some aspects, the brake device 10 can comprise at least one selected instrument 70 that is secured to the threaded connector 50 of the brake device. In exemplary aspects, the at least one selected instrument 70 can comprise a device that is configured to measure at least one characteristic of the drill string and/or the borehole. Optionally, in these aspects, the at least one characteristic of the drill string can comprise a direction of the borehole, a dip angle of the borehole, pressure within the drill string, a pressure change within the drill string, gravitational field strength, an angular measurement (azimuth) relative to a reference point within the drill string, or combinations thereof. In further exemplary aspects, the at least one selected instrument 70 can comprise an accelerometer, a gyroscope, a vibration sensor, a gravity sensor, a magnetic field sensor, an inclinometer, a direction-measuring sensor, a camera, or combinations thereof. In these aspects, the at least one selected instrument can comprise a self-powered electronic (accelerometers, gyroscopes, etc.) or electro-mechanical (gyro's, orientation cameras, etc.) hole direction and azimuth measuring and recording device that is configured to survey the drill string. In other aspects, the at least one selected instrument can comprise one or more self-powered electro-magnetic, magnetic or radiation sensing and recording survey devices that are either (a) configured to survey the ground through the drill string wall or (b) sufficiently elongated to protrude from the distal end of the drill string (through the drill bit when slightly retracted off bottom) to directly sample or scan the ground. For example and without limitation, the survey devices can directly or scan the ground of the formation by direct contact means (e.g., contact pressure, chemical reaction, electrical conductivity, and the like), by proximity means (e.g., sensing gaseous emissions or reactions, magnetic or inductive reaction, and the like), or remote means (e.g., visual photography, spectrography or XRF, radioactivity sensing, laser ablation reaction sensing, and the like).

In operation, it is contemplated that the methods of obtaining data using the disclosed instruments and survey tools are generally unlimited in that measurements can be taken as the brake device is tripped in or out of the drill string or incrementally/progressively with a trip of the brake device after each segment of the drill hole is cut.

Figure 6:
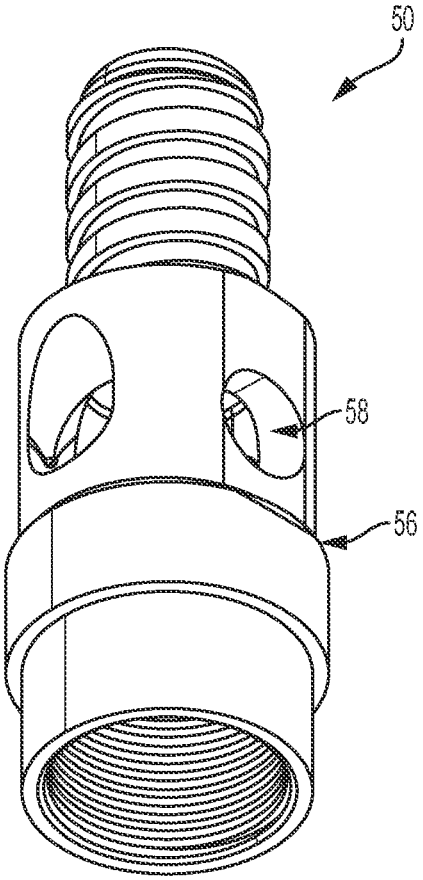
FIG. 6 is a perspective view of an exemplary threaded connector of a brake device as disclosed herein.
Figure 7:
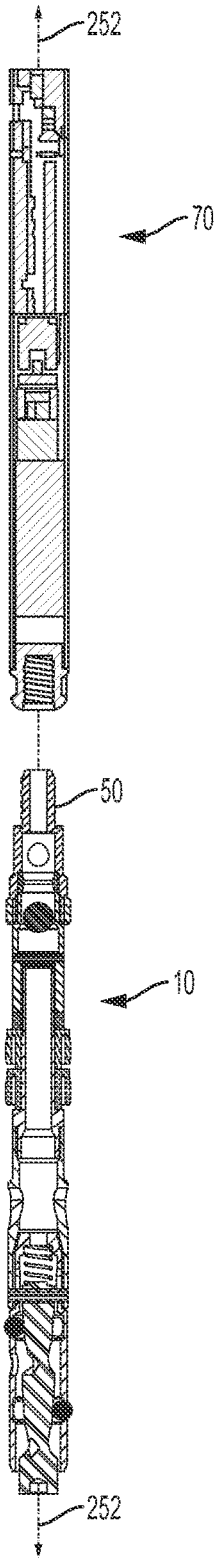
FIG. 7 is a cross-sectional view of an exemplary instrument and an exemplary brake device that can be connected to one another as disclosed herein.

In a further aspect, as shown in FIGS. 3 and 6, the brake device 10 can define a shoulder surface 56 proximate the threaded connector 50. In this aspect, the threaded connector 50 can be configured to engage a landing ring at a distal end of the drill string 250.

In another aspect, the brake device 10 can further comprise a mid-body portion 80. In this aspect, the mid-body portion 80 can have an inner surface 82 that defines a central bore 84 and a proximal seat 86 positioned within the central bore. The central bore 84 of the mid-body portion 80 can be positioned in fluid communication with the central bore 38 of the brake retainer 30, and the distal end 34 of the brake retainer 30 can be at least partially received within the central bore of the mid-body portion and can abut the proximal seat 86 of the mid-body portion 80. In an additional aspect, the inner surface 36 of the brake retainer 30 can define a seat 40 within the central bore 38 of the brake retainer. In this aspect, it is contemplated that the biasing member 44 can have a distal end that abuts the seat 40 within the central bore 38 of the brake retainer 30. In exemplary aspects, as shown in FIG. 3, the driving member 20 can be coupled to the brake retainer 30 and/or the mid-body portion 80 using a pin 25 that extends through a bore defined in a distal portion of the driving member.

In a further aspect, the brake device 10 can further comprise a landing indicator valve 90 positioned between the threaded connector 50 and the mid-body portion 80 relative to the longitudinal axis 252 of the drill string 250. In this aspect, the landing indicator valve 90 can be positioned in fluid communication with the central bore 84 of the mid-body portion 80. Optionally, in an aspect, the landing indicator valve 90 can comprise a ball or piston 92 at least partially received within a ring or bushing 94. In this aspect, the ball or piston 92 can be configured for passage through the ring or bushing 94 upon landing of the brake device 10 on a landing ring positioned at a distal portion of the drill string 250. In use, the valve ball or piston 92 can be driven back from a distal position to a proximal position when the brake is applied (e.g., the braking elements are radially deployed as disclosed herein) against drill string fluid pressure or ground source flows. Optionally, when the landing indicator valve 90 comprises a ball, the landing indicator valve can comprise a pin 95 that is positioned to limit the proximal travel of the ball to prevent it from fully seating against a proximal shoulder of mating parts and allowing distal pressurized flows to vent or dissipate through the braking device. For example, if the braking device is pumped into a drill string with a trapped and/or lodged drilling tool, then pressure may build between the drilling tool and the braking device as the braking device approaches. Optionally, as shown in FIG. 3, the ball can be allowed to seal against distal flows, in which case the braking elements must retain the full force. In exemplary aspects, as shown in FIG. 3, the pin 95 can be positioned within the distal body portion 100 at a location distal of the elongate spindle 120. Optionally, when the landing indicator valve 90 comprises a piston, it is contemplated that the piston can be operatively coupled to another portion of the brake device 10, with a portion of the valve piston being configured for passage through a ring or bushing 94 upon landing of the brake device 10 on a landing ring as further disclosed herein.

In exemplary aspects, the ring or bushing 94 can comprise a flexible material, such as for example and without limitation, nylon, NYLATRON™, and the like. Optionally, in further exemplary aspects, the ring or bushing 94 can comprise a fluid control assembly having a longitudinal axis and including at least one spiral ring and a bushing. Each spiral ring can have inner surfaces that cooperate to define an inner diameter of the spiral ring and outer surfaces that cooperate to define an outer diameter of the spiral ring. Each spiral ring can be configured for axial and radial compression and expansion relative to the longitudinal axis. The bushing can have an inner surface that defines an inlet, an outlet, a central bore extending between the inlet and the outlet, and at least one slot positioned in communication with the central bore at a location between the inlet and the outlet. At least one slot of the bushing can be configured to receive the at least one spiral ring, and the at least one slot can be configured to retain the at least one spiral ring during axial and radial compression and expansion of the at least one spiral ring. Exemplary fluid control assemblies having these features are disclosed in U.S. Provisional Patent Application No. 62/110,007, filed on Jan. 30, 2015 and incorporated herein by reference.

In additional aspects, the threaded connector 50 of the brake device 10 can have an exterior threaded portion 52 and an interior threaded portion 54. In these aspects, the brake device 10 can further comprise a distal body portion 100 and an elongate spindle 120. In one aspect, the distal body portion 100 can be positioned in engagement with the interior threaded portion 54 of the threaded connector 50. It is contemplated that the distal body portion 100 can define a central bore 110 that extends proximally relative to the threaded connector 50. In exemplary aspects, and as shown in FIG. 3, the landing indicator valve can be positioned within a distal portion of the central bore 110 of the distal body portion 100. In these aspects, and as shown in FIGS. 3 and 6, it is contemplated that the threaded connector 50 can have a central bore positioned in communication with the central bore 110 of the distal body portion, with the threaded connector 50 defining a plurality of radial openings 58. It is further contemplated that upon movement of the landing indicator valve 90 (e.g., movement of ball 94 through ring 92) following landing of the brake device 10 as further disclosed herein, the radial openings 58 of the threaded connector can permit detection of the landing through a change in fluid pressure.

In another aspect, the elongate spindle 120 can have a proximal portion 122 received within the central bore 84 of the mid-body portion 80, a distal portion 124 received within the central bore 110 of the distal body portion 100, and a flange portion 126 positioned between the proximal and distal portions relative to the longitudinal axis 252 of the drill string 250. In this aspect, the flange portion 126 can engage the mid-body portion 80. It is contemplated that the elongate spindle 120 can define a central bore 128 positioned in communication with the central bores 110, 84 of the distal body portion 100 and the mid-body portion 80.

In further exemplary aspects, the brake device 10 can further comprise at least one sealing element 130 that circumferentially surrounds a portion of the elongate spindle 120 positioned between the distal body portion 100 and the flange portion 126 of the elongate spindle relative to the longitudinal axis 252 of the drill string 250. In use, it is contemplated that the brake device 10 can be configured to form a fluid-tight seal with the inner surface 254 of the drill string 250 (or the inner surface of the borehole). In exemplary aspects, the sealing elements 130 can be pump-in seals as are known in the art. In further exemplary aspects, it is contemplated that the sealing elements 130 can be variable-diameter seals that are configured to form a seal with different inner diameters of a variable-diameter drill rod as are disclosed in U.S. Pat. No. 8,770,319, which is incorporated herein by reference in its entirety. Optionally, as shown in FIG. 3, the brake device 10 can comprise a nut 115 that is positioned axially between the sealing elements 130 and the distal body portion 100.

In exemplary aspects, and as further disclosed herein, the disclosed brake device can be provided as a component of a drilling system. In these aspects, the drilling system can comprise a drill string, an inner tube assembly, and the brake device. As further disclosed herein, the brake device is not coupled to the inner tube assembly.

In use, the disclosed brake device and drilling system can be employed in a drilling method. In one aspect, the drilling method can comprise arranging the drill string within the borehole. In another aspect, the drilling method can comprise advancing the inner tube assembly within the drill string. In a further aspect, the drilling method can comprise advancing the brake device within the drill string. In this aspect, as further disclosed herein, the biasing member of the brake retainer of the brake device biases the driving member in a proximal direction relative to the longitudinal axis of the drill string to position the plurality of wedge surfaces of the driving member of the brake device in contact with corresponding braking elements of the plurality of braking elements of the brake device. Additionally, as further disclosed herein, the plurality of wedge surfaces of the driving member drive the plurality of braking elements radially outwardly into corresponding radial openings of the brake retainer to engage the inner surface of the drill string (or the inner surface of the borehole). As still further disclosed herein, the brake device is not coupled to the inner tube assembly. Optionally, advancing the brake device within the drill string can comprise engaging a landing ring at the distal end of the drill string with the shoulder surface of the brake device as further disclosed herein.

In exemplary aspects, the drilling method can further comprise moving the brake device in a proximal direction relative to the drill string. In these aspects, upon moving the brake device in the proximal direction, the wedge surfaces of the driving member of the brake device can wedge the plurality of braking elements against the inner surface of the drill string. Upon wedging of the plurality of braking elements against the inner surface of the drill string (or against an inner surface of a borehole), the brake device is axially locked relative to the longitudinal axis of the drill string.

In further exemplary aspects, the drilling method can further comprise moving the brake device in a distal direction relative to the drill string. In these aspects, upon moving the brake device in the distal direction, the wedge surfaces of the driving member of the brake device do not wedge the plurality of braking elements against the inner surface of the drill string.

In still further exemplary aspects, when the brake device comprises a threaded connector as disclosed herein, the drilling method can further comprise securing a selected instrument to the threaded connector of the brake device. In these aspects, the drilling method can still further comprise using the selected instrument to measure at least one selected characteristic of the borehole.

In exemplary aspects, the brake device 10 can be pumped in as disclosed herein, but the brake device can be configured to remain within the drill string until the drill string is retrieved using conventional methods. In these aspects, it is contemplated that a retracting case can be deployed to position the braking elements in a retracted position in which the braking elements are radially spaced from the inner surface of the drill string (or an inner surface of a borehole). Alternatively, in other exemplary aspects, the brake device 10 can comprise a spearpoint assembly and/or define an internal groove that is configured for engagement or coupling with a wireline overshot device as is known in the art. In these aspects, it is contemplated that the brake device 10 can be retracted while leaving the inner tube assembly and the remainder of the drill string in place within the borehole.

In some embodiments, the braking device 10 may have other uses. For example, the braking device 10 may be used as a plug in a drill rod string, or any conduit, having pressure at a distal location. In another example, the braking device 10 can be used to explore for a broken portion of a drill rod string or conduit by inserting under pressure until prevented by deformed members or by pressure loss.

All publications and patent applications mentioned in the specification are indicative of the level of those skilled in the art to which this invention pertains. All publications and patent applications are herein incorporated by reference to the same extent as if each individual publication or patent application was specifically and individually indicated to be incorporated by reference.

Although the foregoing invention has been described in some detail by way of illustration and example for purposes of clarity of understanding, certain changes and modifications may be practiced within the scope of the appended claims.

What is claimed is:

1. A brake device for engaging an inner surface of a drill string within a borehole, the brake device being configured for axial movement relative to a longitudinal axis of the drill string, the brake device comprising:

a driving member having an outer surface that defines a plurality of wedge surfaces;

a brake retainer having an inner surface that defines a central bore that receives at least a portion of the driving member, wherein the brake retainer defines a plurality of radial openings positioned in communication with the central bore, and wherein the brake retainer comprises a biasing member that is operatively coupled to the driving member;

a plurality of braking elements positioned in contact with at least a portion of the outer surface of the driving member; and a mid-body portion, the mid-body portion having an inner surface that defines a central bore and a proximal seat positioned within the central bore, wherein the brake retainer has a distal end that is at least partially received within the central bore of the mid-body portion and that abuts the proximal seat of the mid-body portion, wherein the biasing member of the brake retainer is configured to bias the driving member in a proximal direction relative to the longitudinal axis of the drill string to position the plurality of wedge surfaces of the driving member in contact with corresponding braking elements of the plurality of braking elements, and wherein the plurality of wedge surfaces of the driving member are configured to drive the plurality of braking elements radially outwardly into corresponding radial openings of the brake retainer to engage the inner surface of the drill string, wherein the brake retainer defines a proximal end of the brake device, wherein the brake device has a threaded connector that defines a distal end that is axially opposed to the proximal end of the brake device, wherein the brake device defines a shoulder surface proximate the threaded connector, wherein the shoulder surface is configured to engage a landing ring at a distal end of the drill string, and wherein the brake device is not coupled to an inner tube assembly.

2. The brake device of claim 1, wherein the wedge surfaces of the driving member are configured to wedge the plurality of braking elements against the inner surface of the drill string when the brake device is moved in a proximal direction relative to the drill string, and wherein upon wedging of the plurality of braking elements against the inner surface of the drill string, the brake device is axially locked relative to the longitudinal axis of the drill string.

3. The brake device of claim 2, wherein the wedge surfaces of the driving member do not wedge the plurality of braking elements against the inner surface of the drill string when the brake device is moved in a distal direction relative to the drill string.

4. The brake device of claim 1, further comprising at least one selected instrument that is secured to the threaded connector of the brake device.

5. The brake device of claim 1, wherein the at least one selected instrument comprises a device that is configured to measure at least one characteristic of the drill string.

6. The brake device of claim 5, wherein the at least one selected instrument comprises an accelerometer, a gyroscope, a vibration sensor, a gravity sensor, a magnetic field sensor, an inclinometer, a direction-measuring sensor, a camera, or combinations thereof.

7. The brake device of claim 5, wherein the at least one characteristic of the drill string comprises a direction of the borehole, a dip angle of the borehole, pressure within the drill string, a pressure change within the drill string, gravitational field strength, an angular measurement (azimuth) relative to a reference point within the drill string, or combinations thereof.

8. The brake device of claim 1, wherein the inner surface of the brake retainer defines a seat within the central bore of the brake retainer, and wherein the biasing member has a distal end that abuts the seat within the central bore of the brake retainer.

9. The brake device of claim 8, further comprising a landing indicator valve positioned between the threaded connector and the mid-body portion relative to the longitudinal axis of the drill string, wherein the landing indicator valve is positioned in fluid communication with the central bore of the mid-body portion.

10. The brake device of claim 9, wherein the landing indicator valve comprises a ball at least partially received within a ring, wherein the ball is configured for passage through the ring upon landing of braking device on a landing ring positioned at a distal portion of the drill string.

11. The brake device of claim 10, wherein the threaded connector has an exterior threaded portion and an interior threaded portion, wherein the brake device further comprises:

a distal body portion positioned in engagement with the interior threaded portion of the threaded connector, wherein the distal body portion defines a central bore that extends proximally relative to the threaded connector;

an elongate spindle having a proximal portion received within the central bore of the mid-body portion, a distal portion received within the central bore of the distal body portion, and a flange portion positioned between the proximal and distal portions relative to the longitudinal axis of the drill string, wherein the flange portion engages the mid-body portion, and wherein the elongate spindle defines a central bore positioned in communication with the central bores of the distal body portion and the mid-body portion.

12. The brake device of claim 11, further comprising at least one sealing element that circumferentially surrounds a portion of the elongate spindle positioned between the distal body portion and the flange portion of the elongate spindle relative to the longitudinal axis of the drill string.

13. The brake device of claim 1, wherein the plurality of braking elements comprises a plurality of rollers.

14. The brake device of claim 1, wherein the plurality of braking elements comprises a plurality of balls.

15. The brake device of claim 1, wherein the brake device is configured to form a fluid-tight seal with the inner surface of the drill string.

16. The brake device of claim 1, wherein the plurality of braking elements comprises a plurality of opposed sets of braking elements, and wherein the plurality of wedge surfaces are axially tapered relative to the longitudinal axis of the drill string.

17. The brake device of claim 1, wherein the driving member comprises a single component that defines the plurality of wedge surfaces.

18. The brake device of claim 1, wherein the driving member comprises a plurality of driving components, and wherein each driving component of the plurality of driving components defines at least one wedge surface of the plurality of wedge surfaces.

19. A drilling system comprising:

a drill string having an inner surface and a longitudinal axis;

an inner tube assembly; and a brake device configured to engage the inner surface of the drill string within a drill hole, the brake device being configured for axial movement relative to the longitudinal axis of the drill string, the brake device comprising:

a driving member having an outer surface that defines a plurality of wedge surfaces;

a brake retainer having an inner surface that defines a central bore that receives at least a portion of the driving member, wherein the brake retainer defines a plurality of radial openings positioned in communication with the central bore, and wherein the brake retainer comprises a biasing member that is operatively coupled to the driving member;

a plurality of braking elements positioned in contact with at least a portion of the outer surface of the driving member; and a mid-body portion, the mid-body portion having an inner surface that defines a central bore and a proximal seat positioned within the central bore, wherein the brake retainer has a distal end that is at least partially received within the central bore of the mid-body portion and that abuts the proximal seat of the mid-body portion, wherein the biasing member of the brake retainer is configured to bias the driving member in a proximal direction relative to the longitudinal axis of the drill string to position the plurality of wedge surfaces of the driving member in contact with corresponding braking elements of the plurality of braking elements, and wherein the plurality of wedge surfaces of the driving member are configured to drive the plurality of braking elements radially outwardly into corresponding radial openings of the brake retainer to engage the inner surface of the drill string, wherein the brake retainer defines a proximal end of the brake device, wherein the brake device has a threaded connector that defines a distal end that is axially opposed to the proximal end of the brake device, wherein the brake device defines a shoulder surface proximate the threaded connector, wherein the shoulder surface is configured to engage a landing ring at a distal end of the drill string, and wherein the brake device is not coupled to the inner tube assembly.

20. The drilling system of claim 19, wherein the wedge surfaces of the driving member of the brake device are configured to wedge the plurality of braking elements against the inner surface of the drill string when the brake device is moved in a proximal direction relative to the drill string, and wherein upon wedging of the plurality of braking elements against the inner surface of the drill string, the brake device is axially locked relative to the longitudinal axis of the drill string.

21. The drilling system of claim 20, wherein the wedge surfaces of the driving member of the brake device do not wedge the plurality of braking elements against the inner surface of the drill string when the brake device is moved in a distal direction relative to the drill string.

22. The drilling system of claim 19, wherein the brake device further comprises at least one selected instrument secured to the threaded connector of the brake device.

23. A drilling method comprising:

arranging a drill string within a borehole, the drill string having an inner surface and a longitudinal axis;

advancing an inner tube assembly within a drill string; and advancing a brake device within the drill string, the brake device comprising:

a driving member having an outer surface that defines a plurality of wedge surfaces;

a brake retainer having an inner surface that defines a central bore that receives at least a portion of the driving member, wherein the brake retainer defines a plurality of radial openings positioned in communication with the central bore, and wherein the brake retainer comprises a biasing member that is operatively coupled to the driving member;

a plurality of braking elements positioned in contact with at least a portion of the outer surface of the driving member; and a mid-body portion, the mid-body portion having an inner surface that defines a central bore and a proximal seat positioned within the central bore, wherein the brake retainer has a distal end that is at least partially received within the central bore of the mid-body portion and that abuts the proximal seat of the mid-body portion, wherein the biasing member of the brake retainer biases the driving member in a proximal direction relative to the longitudinal axis of the drill string to position the plurality of wedge surfaces of the driving member in contact with corresponding braking elements of the plurality of braking elements, and wherein the plurality of wedge surfaces of the driving member drives the plurality of braking elements radially outwardly into corresponding radial openings of the brake retainer to engage the inner surface of the drill string, wherein the brake retainer defines a proximal end of the brake device, wherein the brake device has a threaded connector that defines a distal end that is axially opposed to the proximal end of the brake device, wherein the brake device defines a shoulder surface proximate the threaded connector, wherein the shoulder surface engages a landing ring at a distal end of the drill string, and wherein the brake device is not coupled to the inner tube assembly.

24. The drilling method of claim 23, further comprising:

moving the brake device in a proximal direction relative to the drill string, wherein upon moving the brake device in the proximal direction, the wedge surfaces of the driving member of the brake device wedge the plurality of braking elements against the inner surface of the drill string, and wherein upon wedging of the plurality of braking elements against the inner surface of the drill string, the brake device is axially locked relative to the longitudinal axis of the drill string.

25. The drilling method of claim 23, further comprising:

moving the brake device in a distal direction relative to the drill string, wherein upon moving the brake device in the distal direction, the wedge surfaces of the driving member of the brake device do not wedge the plurality of braking elements against the inner surface of the drill string.

26. The drilling method of claim 23, wherein the drilling method further comprises:

securing a selected instrument to the threaded connector of the brake device; and using the selected instrument to measure at least one selected characteristic of the borehole.

* * * * *